US006199956B1

(12) United States Patent
Kammerer

(10) Patent No.: US 6,199,956 B1
(45) Date of Patent: Mar. 13, 2001

(54) ROUND-SHANK BIT FOR A COAL CUTTING MACHINE

(75) Inventor: Karl Kammerer, Fluorn-Winzeln. (DE)

(73) Assignee: Betek Bergbau- und Hartmetalltechnik Karl-Heinz-Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/238,999

(22) Filed: Jan. 27, 1999

(30) Foreign Application Priority Data

Jan. 28, 1998 (DE) ..... 198 03 166

(51) Int. Cl.[7] ..... E21C 35/18
(52) U.S. Cl. ..... 299/111; 299/79.1; 299/113
(58) Field of Search ..... 299/79.1, 101, 299/102, 103, 111, 113

(56) References Cited

U.S. PATENT DOCUMENTS 5,161,859 * 11/1992 Larsson et al. ..... 299/111
5,219,209 * 6/1993 Prizzi et al. ..... 299/111
5,324,098 6/1994 Massa et al. ..... 299/111
5,484,191 * 1/1996 Sollami ..... 299/111
5,551,760 * 9/1996 Sollami ..... 299/111
5,873,423 * 2/1999 Breise ..... 299/113
5,931,542 * 8/1999 Britzke et al. ..... 299/104

FOREIGN PATENT DOCUMENTS 34 42 546 A1 5/1986 (DE) .
3712427 * 10/1988 (DE) .

* cited by examiner

*Primary Examiner*—Eileen D. Lillis
*Assistant Examiner*—John Kreck
(74) *Attorney, Agent, or Firm*—Pauley Petersen Kinne & Fejer

(57) ABSTRACT

A round-shank bit for a coal cutting machine or the like, having a bit head and a bit shank, wherein the bit head has a bit tip, maintained by a base element in a receptacle of the bit head. Starting at the base element, the bit tip tapers in a direction toward the free end of the bit tip, wherein the base element forms a maximum diameter of the bit tip, and wherein the bit tip has recesses on its outer contour. In order to assure good rotational behavior over the entire length of the operating time, the base element has the recesses on an outer circumference forming the maximum diameter.

10 Claims, 2 Drawing Sheets

ROUND-SHANK BIT FOR A COAL CUTTING MACHINE

BACKGROUND OF THE INVENTION

1. Field of the Invention

This invention relates to a round-shank bit for a coal cutting machine or the like, having a bit head and a bit shank, wherein the bit head has a bit tip, maintained by a base element in a receptacle of the bit head, and starting at the base element, the bit tip tapers in a direction toward a free end of the bit tip, wherein the base element forms a maximum diameter of the bit tip, and the bit tip has recesses on an outer contour.

2. Description of Prior Art

A conventional round-shank bit is known from German Patent Publication DE 34 42 546 A1.

Such round-shank bits are installed in bit holders, which are fastened to a rotating body. When using the tool, the bit tips engage and penetrate the material to be removed, for example, rocks, coal, road covering and the like. The bit tip wears during this engagement. In order to obtain even wear over the entire circumference of the bit tip, the bit shank of the round-shank bit is rotatably held in a bit holder. For improving the rotational behavior of the round-shank bit known from German Patent Publication DE 34 42 546 A1, the bit tip has recesses on an outer circumference, which extend in a longitudinal direction of the round-shank bit. In this case the recesses extend from the bit tip as far as the bit head, where the recesses end continuously. Because of the cross-sectional weakening as a result of the recesses, rapid wear of the bit tip results when these conventional round-shank bits are used. The round-shank bit furthermore has a tendency for blockage when the lands formed between the recesses are worn out, but when the wear limit is not quite reached.

SUMMARY OF THE INVENTION

It is one object of this invention to create a round-shank bit of the type mentioned above, wherein a good rotational behavior over an entire length of wear is assured.

This object is attained with a base element having recesses on its outer circumference, which constitutes the maximum diameter.

With the arrangement of the recesses in accordance with this invention, the outer contour of the bit tip on a side facing the bit head has alternatingly recesses and intermediate elements located between the recesses. This results, for example, in a star-shaped or a tooth-shaped outer contour of the base element. When using the tool, the removed material is taken away in a definite manner via the recesses toward the bit head. Thus, an intentional wear of the bit head is caused, which carries the recesses on in the form of wash-outs in the bit head.

In connection with the feed movement of the tool, the removed material introduces a force component in a circumferential direction into the round-shank bit via the recesses and wash-outs. Thus, the rotating property of the round-shank bit is assured up to the wear limit. The design of the bit tip in accordance with this invention also utilizes knowledge that in a not yet worn out state the bit tip must have sufficient support on the bit head in order to be able to dependably deflect occurring transverse forces. During increasing wear, however, lesser bending stresses are transmitted via the transition between the bit tip and the bit head because of the wear-induced shortening of the bit tip. At the beginning of use, the intermediate elements between the recesses assure sufficient support of the bit tip. With increasing wear the intermediate elements are also ground down, so that the contact surface of the bit tip on the bit head is reduced. Thus, with increasing shortening of the bit tip, the diameter of the base element and of the bit head are also reduced, so that the round-shank bit retains a cutting-friendly slim geometry up to the time it fails.

In accordance with a preferred embodiment of this invention, the recesses are uniformly cut into the base element up to an interior graduated circle extended around the center longitudinal axis of the bit tip. In a plan view the bit tip is designed star-shaped on its outer contour defined by the base element. A uniform rotational behavior can also be assured because of the uniform erosion of the recesses.

If the recesses terminate continuously and directly in the tapered area of the bit tip adjoining the base element, a precise flow of the removed material becomes possible. In order not to cause an unnecessary weakening of the bit tip and rapid wear, the recesses should terminate directly adjoining the base element.

A preferred embodiment is distinguished because the receptacle in the bit head is enclosed by a collar around the circumference, and the recesses extend in the axial direction of the bit tip past the collar into the contact surface of the bit tip on the bit head. With a round-shank bit of this type the recesses do not contact or only partially contact the removed material at initial use of the tool. In this state the round-shank bit is capable of sufficient rotation because of its geometry alone. When used, the collar is ground off and the recesses are increasingly exposed. Thus, the support of the rotation in accordance with the invention then becomes effective.

In another preferred embodiment of this invention, the area of a free end of the bit tip has a conical first area, which makes a transition into a second cylindrical transition area, and following the cylindrical transition area, the bit tip extends in a direction toward the base element over a truncated cone-shaped or concavely tapered area. A round-shank bit of this type has very good cutting properties and a long service life.

Long service life can also be achieved if in the region of the free end the bit tip has a conical or approximately conical area, and if a second area in the shape of a truncated cone or nearly truncated cone adjoins the first area, having a cone opening angle less than the cone opening angle of the first area. The second area transitions into the base element via a further, third area in the shape of a truncated cone or nearly truncated cone, wherein the cone opening angle of the third area is greater than the cone opening angle of the second area.

This invention will be explained in greater detail in view of an exemplary embodiment represented in the drawings.

DESCRIPTION OF PREFERRED EMBODIMENTS

Figure 1:
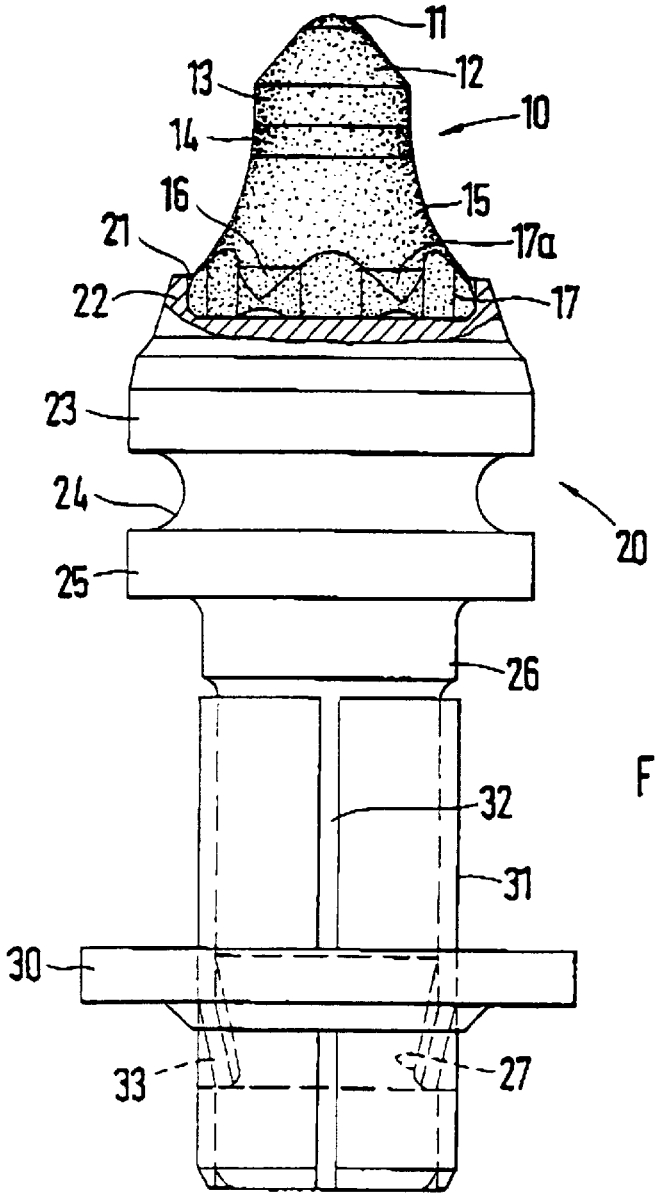
FIG. 1 is a partial sectional side view of a round-shank bit.

A round-shank bit is shown in a partial sectional side view in FIG. 1. Essentially, the round-shank bit comprises a bit tip

10, a bit head 20 and a bit shank 26. A clamping sleeve 31 is drawn on the cylindrical bit shank 26. Tabs 33 are stamped out from the clamping sleeve 31 and are bent off in a direction toward the bit shank 26. The tabs 33 engage a circumferential groove 27 of the bit shank 26 and prevent the clamping sleeve 31 from being pulled off the bit shank 26. A bore in a wear-protection disk is pushed on the clamping sleeve 31 in the area of the tabs 33. The diameter of the bore is of such a size that the clamping sleeve 31 is maintained in a prestressed state. With the bit shank 26, the round-shank bit can be inserted into a bore of the bit holder. In this case, the diameter of the bore is of such a size that the clamping sleeve 31 of the round-shank bit can be inserted with only a relatively small force. When the round-shank bit contacts the bit holder with its wear-protection disk 30, the insertion of the bit shank 26 can have an increased force. In the process, the wear-protection disk 30 is displaced in the direction toward the bit head 20 until there is no contact with the clamping sleeve 31. The clamping sleeve 31 then expands, and the longitudinal slit 32 is widened. The clamping sleeve 31 is then braced in the bore of the bit holder. The wear-protection disk 30 rests on the surface of the bit holder 26 and protects against wear created by rotation of the round-shank bit.

The bit head 20 adjoins the bit shank 26 by means of a cylindrical element 25. The cylindrical element 25 transitions into a constriction 24, which in turn terminates in a further cylindrical element 23. A tool can be inserted into the constriction, by means of which the round-shank bit can then be pulled out of the bore of the bit holder, when worn out.

On an end remote from the shank bit, the bit head 20 has a receptacle 21 bordered by a circumferential collar 22. The receptacle 21 has a flat contact surface, on which the bit tip 10 is placed and soldered.

The bit tip 10 is designed as a hard metal insert. The bit tip 10 has a base element 16, which is inserted into the receptacle 21. Adjoining the base element 16, the bit tip 10 transitions via a tapered area 15 into a cylindrical transition area. The tapered area 15 is designed concave, wherein the bit tip 10 widens, starting at the cylindrical transition area 13, in the direction toward the base element 16. Accordingly, the base element 16 has a maximum diameter of the dynamically balanced bit tip 10. Between tapered area 15 and cylindrical transition area 13 is a truncated conical area 14 of right circular cone shape. The bit tip 10 has a first area 12 in the shape of a truncated cone on the free end, which is closed off by a rounded portion 11.

Recesses 17 are cut out of the exterior circumference of the bit tip 10 in the transition area between the base element 16 and the tapered area 15. In this case, the recesses 17 are cut into the base element 16 in a pocket shape and terminate continuously in the tapered area 15. Land-shaped intermediate elements 17*a* are formed between the individual recesses 17, by means of which the bit tip 10 is supported on the contact surface of the receptacle 21.

Figure 2:
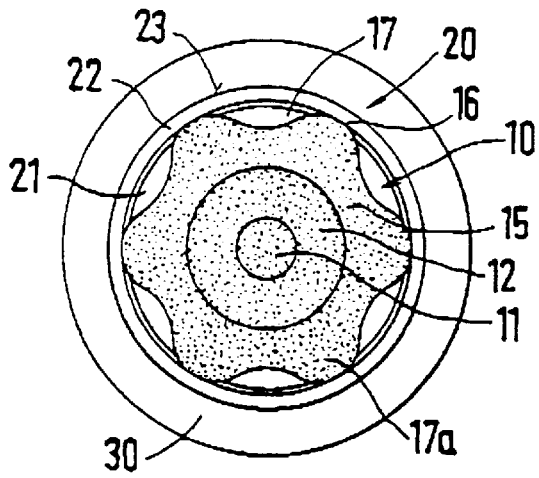
FIG. 2 is a top view of the round-shank bit shown in FIG. 1.

The geometry of the bit tip 10 in the area of the collar 17 is evident from FIG. 2, which shows the round-shank bit in a top view. Together with the intermediate elements 17*a*, the recesses 17 provide the bit tip 10 with a star-shaped geometry.

Figure 3:
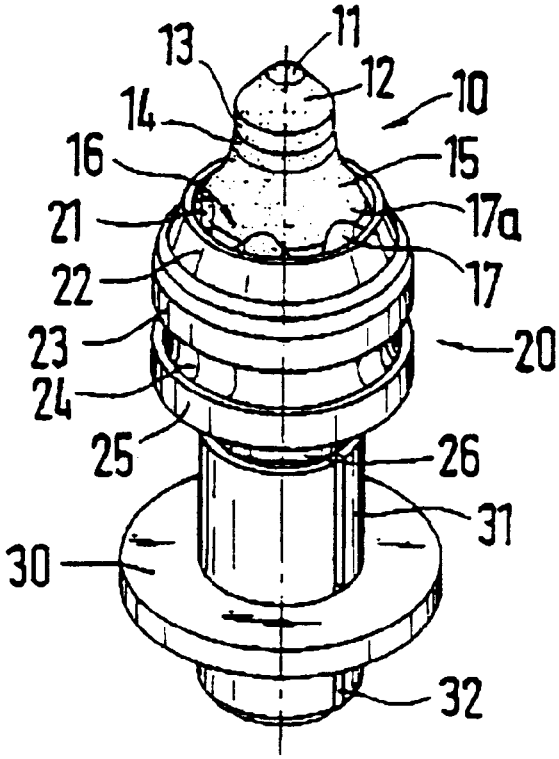
FIG. 3 is a perspective view of the round-shank bit shown in FIGS. 1 and 2.

The round-shank bit represented in FIGS. 1 and 2 is shown in a perspective view in FIG. 3. As can be seen from this representation, the recesses 17 form transition areas into the bit head 20.

Figure 4:
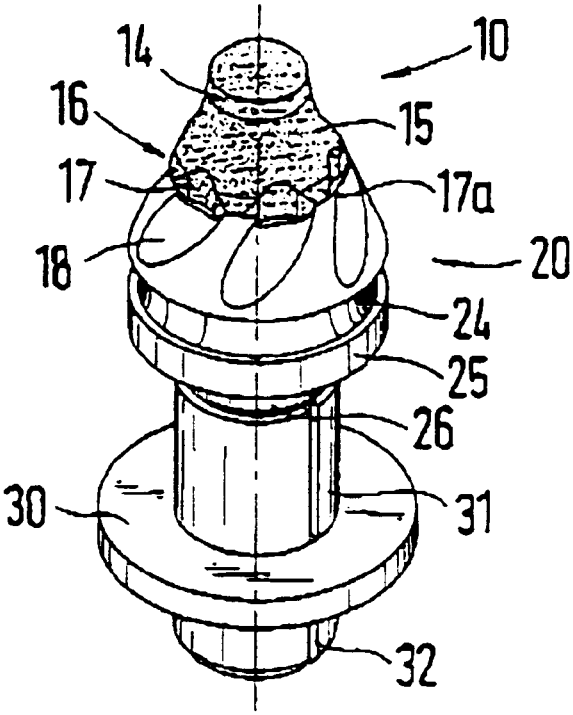
FIG. 4 is a perspective view of the round-shank bit shown in FIG. 3, but in the worn out state.

When the tool is in use, the material to be removed is cut off by the bit tip 21. The removed material then flows past the tapered area 15 toward the recesses 17, and in the process grinds past the bit head 20. When working, the recesses 17 continue in the bit head 20 in the form of wash-outs 18, as shown in FIG. 4. Since the round-shank bit rotates when in use, the wash-outs 18 are created in a twist-like manner around the center longitudinal axis of the round-shank bit. The recesses 17, and later on the wash-outs 18, make it possible for the removed material to introduce a force in the circumferential direction of the bit head 20. By means of this the rotating movement of the round-shank bit is assisted, for optimizing wear.

The cutting-friendliness of the round-shank bit is also assisted by the recesses 17, in accordance with this invention.

As FIG. 4 shows, the wash-outs 18 reduce the exterior cross section of the bit head 20 in a predeterminable manner. The intermediate elements 17*a* offer a sufficient support width on the contact surface of the receptacle 21, so that the occurring transverse forces can be dependably absorbed. If, because of wear, the bit tip 10 experiences a shortening in the axial direction when used, the support width can then also be increasingly reduced. This invention compensates for continuous wear of the intermediate elements 17*a* after the wash-outs 18 are ground. Because of this simple measure the slim, cutting-friendly geometry of the round-shank bit 10 is always maintained over the entire length of the operation.

What is claimed is:

1. In a round-shank bit for a coal cutting machine or a similar machine, having a bit head and a bit shank, wherein the bit head has a bit tip maintained by a base element in a receptacle of the bit head, wherein starting at the base element the bit tip tapers in a direction toward a free end of the bit tip, wherein the base element forms a maximum diameter of the bit tip, and wherein the bit tip has recesses on an outer contour, the improvement comprising:

the base element (16) having the recesses (17) on an outer circumference of the base element forming the maximum diameter; a clamping sleeve (31) surrounding the bit shank (26), the clamping sleeve having tabs (33) stamped out therefrom and bent off in a direction toward the bit shank, the tabs engaging a circumferential groove (27) formed in the bit shank thereby preventing the clamping sleeve from being pulled off the bit shank, the clamping sleeve further having a longitudinal slit (32); a wear-protection disk (30) having a bore therein, the wear-protection disk bore fitting over the clamping sleeve in the area of the tabs so as to maintain the clamping sleeve is in a prestressed state whereby its longitudinal slit is of a first width; and the wear-protection disk being displaceable in a direction toward the bit head to a position having no contact with the clamping sleeve whereby the clamping sleeve longitudinal slit is of a second width wider than said first width; and wherein, extending in the direction toward the base element (16), the bit tip (10) has a free end area of the bit tip (10) with a rounded foremost point (11) joined directly to and transitioning into a truncated conical first area (12) of right circular cone shape, the conical first area joined directly to and transitioning into a cylindrical transition area (13), the cylindrical transition area joined directly to and transitioning into a truncated conical second area (14) of right circular cone shape, the truncated conical second area (14) joined directly to and transitioning into a truncated conical third area (15) having concavely tapered sides rather than being of right circular cone shape, with all the transitionings being flush thereby presenting a smooth-faced outer surface of the bit tip.

2. In the round-shank bit in accordance with claim 1, wherein a plurality of intermediate elements (17*a*) are arranged between the recesses (17), the intermediate elements (17*a*) extend as far as the maximum diameter of the bit tip, and the recesses (17) extend as far as a contact surface of the bit tip with the bit head.

3. In the round-shank bit in accordance with claim 2, wherein the recesses (17) are uniformly cut into the base element (16) up to an interior graduated circle extending around a center longitudinal axis of the bit tip (10), and the bit tip (10) is star-shaped on the outer contour defined by the base element (16).

4. In the round-shank bit in accordance with claim 3, wherein the recesses (17) terminate in a tapered area of the bit tip (10) adjoining the base element (16).

5. In the round-shank bit in accordance with claim 4, wherein a receptacle contact surface (21) in the bit head is circumferentially enclosed by a collar (22), and the recesses (17) extend in an axial direction away from the bit tip (10) beyond the collar (22) into the contact surface of the bit tip (10) with the bit head.

6. In the round-shank bit in accordance with claim 1, wherein near the free end the bit tip has a conical first area, a second area shaped as a truncated cone adjoins the first area, a cone opening angle of the second area is less than a cone opening angle of the first area, and the second area transitions into the base element (16) via a third area shaped as a truncated cone, wherein a cone opening angle of the third area is greater than the cone opening angle of the second area.

7. In the round-shank bit in accordance with claim 1, wherein the recesses (17) are uniformly cut into the base element (16) up to an interior graduated circle extending around a center longitudinal axis of the bit tip (10), and the bit tip (10) is star-shaped on the outer contour defined by the base element (16).

8. In the round-shank bit in accordance with claim 1, wherein the recesses (17) terminate in a tapered area of the bit tip (10) adjoining the base element (16).

9. In the round-shank bit in accordance with claim 1, wherein a receptacle contact surface (21) in the bit head is circumferentially enclosed by a collar (22), and the recesses (17) extend in an axial direction away from the bit tip (10) beyond the collar (22) into the contact surface of the bit tip (10) with the bit head.

10. In the round-shank bit in accordance with claim 1, wherein near the free end the bit tip has a conical first area, a second area shaped as a truncated cone adjoins the first area, a cone opening angle of the second area is less than a cone opening angle of the first area, and the second area transitions into the base element (16) via a third area shaped as a truncated cone, wherein a cone opening angle of the third area is greater than the cone opening angle of the second area.

* * * * *